United States Patent [19]

Kallianos et al.

[11] 4,319,585

[45] Mar. 16, 1982

[54] 7-METHYL-1,2-BENZOPYRONE AS A TOBACCO FLAVORANT

[75] Inventors: Andrew G. Kallianos, Durham, N.C.; Everett W. Southwick, Richmond, Va.

[73] Assignee: Liggett Group Inc.

[21] Appl. No.: 147,079

[22] Filed: May 7, 1980

[51] Int. Cl.[3] ..... A24B 3/12

[52] U.S. Cl. ..... 131/275; 131/277

[58] Field of Search ..... 131/17 R, 144, 275, 131/276, 277

[56] References Cited

U.S. PATENT DOCUMENTS 4,163,453 8/1979 Kallianos et al. ..... 131/17 R

OTHER PUBLICATIONS

*Perfume and Flavor Chemicals* (Aroma Chemicals) II by Stephen Arctander Published by Author 1969 Montclair, N.J.

*Primary Examiner*—V. Millin

*Attorney, Agent, or Firm*—Kenyon & Kenyon

[57] ABSTRACT

A process for improving, enhancing or modifying the organoleptic properties of tobacco products which comprises adding thereto 7-methyl-1,2-benzopyrone.

5 Claims, No Drawings

7-METHYL-1,2-BENZOPYRONE AS A TOBACCO FLAVORANT

The present invention relates to a tobacco product and has for an object the provision of a natural or synthetic tobacco composition having improved aroma and flavor.

It is well known, as far as the ultimate consumer is concerned, that flavor and aroma are perhaps the largest factors in his selection of a smokeable tobacco product. In the case of most tobacco products manufactured today the desired flavor and aroma are achieved by the blending of domestic and oriental tobaccos each of which contributes its own characteristic aroma and flavor during smoking. However, the manufacturer may be restricted in achieving a desirable product because of limitations on the available types of tobacco with which he can work.

Accordingly, a variety of flavorants have been employed to modify available tobaccos to impart organoleptic characteristics of less readily available and/or more expensive tobaccos, or to impart distinct, new organoleptic properties. Among the flavorants which have been employed are deertongue leaves and ground tonka beans, which impart a characteristic tobacco character with a smooth sweetness.

More recently, efforts have centered on substituting synthetic flavorants for the natural extracts, which may be difficult to obtain, expensive and/or of variable composition. To this end, the principal flavor components of natural substances have been synthesized. In the case of deertongue and tonka, this component was found to be 1,2-benzopyrone (or coumarin); however, when synthetic coumarin was employed as a tobacco flavorant, it was found that important nuances of flavor imparted by deertongue and tonka were absent.

According to U.S. Pat. No. 4,163,453, certain 7-alkoxy-1,2-benzopyrones, and in particular 7-methoxy-1,2-benzopyrone, are useful as tobacco flavorants. However, these alkoxycoumarins also failed to duplicate the flavor characteristics of natural deertongue leaves or ground tonka beans. Consequently, there remains a need for synthetic flavorant which more closely approaches the flavor characteristics of these natural substances.

It is an object of the present invention to ameliorate the restrictive conditions inherent in blending by utilizing a new class of additive materials which, when applied to the tobacco or the tobacco product, improves and enhances the flavor and aroma of the tabacco smoke emitted from these products thereby enhancing the pleasure derived by the consumer.

A further object of this invention is the provision of a process for enhancing or otherwise improving the flavor and aroma of certain domestic, oriental, reconstituted or synthetic tobaccos and blends thereof which may be deficient in said flavor or aroma.

An additional object of this invention is to provide a smoking product, such as cigarettes, cigars, or pipe tobacco, and a process for forming same whereby the flavor and aroma of the tobacco smoke include characteristics similar to those imparted by deertongue or tonka, and thus are enhanced during smoking.

Still another object of this invention is the provision of a tobacco product modified by a synthetic flavorant which more closely approximates the organoleptic characteristics of deertongue and tonka.

Further and additional objects will appear from the following description and the appended claims.

In accordance with the practice of the present invention the flavor and aroma of tobacco smoke from a natural or synthetic tobacco composition is improved by adding to the tobacco 7-methyl-1,2-benzopyrone, or 7-methylcoumarin, which may be represented by the structural formula:

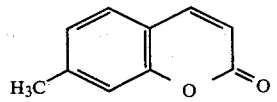

The compound, 7-methyl-1,2-benzopyrone is readily prepared by the acid catalyzed reaction of meta-cresol with either fumaric acid or malic acid.

In the practice of the present invention, 7-methyl-1,2-benzopyrone is added to tobacco, both natural and synthetic, or applied to a tobacco product or its component parts to modify or enhance the flavor thereof. The present invention is especially useful in modifying the flavor of cigarette tobacco. The quantity of flavorant employed is not narrowly critical and can vary over a wide range. Normally the flavorant is added in an amount to give a final concentration of from about 0.0001 to about 0.1 weight percent, preferably from about 0.001 to about 0.01 weight percent, based on the weight of the tobacco or the tobacco product. However, the amount used will depend upon the flavor desired.

The flavoring agent of the present invention may be incorporated at any step in the processing of tobacco. It may be applied to the individual tobacco blend components, such as the natural tobaccos, reconstituted tobacco sheet, or tobacco substitutes of natural or synthetic origin. Preferably the additive is added after aging, curing and shredding and before the tobacco is formed into cigarettes.

Furthermore, the flavoring agent of this invention may be blended with the tobacco in any convenient manner. For example, it can be dissolved in ethanol, acetone or any other suitable solvents, or admixed with a carrier such as casing solution to form a suspension or dispersion, and the resulting combination sprayed, dipped or otherwise applied on the tobacco. Thus water or volatile organic solvents, such as alcohol; glycols, for instance propylene glycol; ether; volatile hydrocarbons; mixtures thereof and the like, may be used as the carrier medium for the agent while it is applied to the tobacco. Alternatively, the agent can be blended with other additives and then mixed into the tobacco. Thus it can be incorporated into blends normally employed to produce reconstituted tobacco sheet or tobacco substitutes of natural or synthetic origin. Inasmuch as the flavoring agent of this invention is somewhat volatile, it may also be incorporated into the filter tip, the seam paste employed for gluing the cigarette paper or the packaging material.

While this invention is principally useful in the manufacture of cigarette tobacco, it is also suitable for use in connection with the manufacture of pipe tobacco, cigars or other tobacco products. The term "tobacco" as used throughout this specification is intended to mean any composition intended for use by smoking or otherwise, whether composed of tobacco plant parts or substitute materials or both.

The following examples are merely illustrative and are not presented as a definition of the limits of the invention. Where the concentration of the additive is given in units of ppm, it has been calculated on a weight basis.

EXAMPLE 1

Preparation of 7-methyl-1,2-benzopyrone from Malic Acid

A suspension of 10.8 g m-cresol, 13.4 g malic acid and 51.5 g concentrated sulfuric acid was heated at 120° for 3 hr. The resulting suspension was poured into water resulting in the immediate formation of a precipitate. The solids were collected by filtration, washed with water and dried briefly in air. Recrystallization from aqueous acetone afforded white crystals of 7-methyl-1,2-benzopyrone, mp 127°-28°.

Infra-red Spectrum ($CCl_4$): 1740, 1615, 1138, 1098 $cm^{-1}$.

Proton Magnetic Resonance Spectrum ($CDCl_3$):

2.46δ (s, 3H)—$CH_3$;
6.35δ (d, 1H);
7.7δ (d, 1H);
7.255 (m, 3H).

| Carbon Magnetic Resonance Spectrum | | |
|---|---|---|
| $C_2$ | 161.3 ppm | (160.8)* |
| $C_3$ | 115.5 | (115.3) |
| $C_4$ | 143.7 | (143.1) |
| $C_5$ | 127.9 | (127.4) |
| $C_6$ | 125.8 | (125.4) |
| $C_7$ | — | (142.9) |
| $C_8$ | 117.0 | (116.8) |
| $C_9$ | 154.4 | (154.0) |
| $C_{10}$ | — | (116.3) |
| $C_7$ methyl | 21.4 | (21.7) |

*Values in parentheses are chemical shifts reported by N.J. Cussans and T. N. Huckerby, Tetrahedron 31, 2591 (1975). Mass Spectrum: m/e 160(86), 132(100), 131(69), 104(50), 103(33).

EXAMPLE 2

Preparation of 7-methyl-1,2-benzopyrone from Fumaric Acid

A suspension of 16.7 g m-cresol and 19.9 g fumaric acid in 100 ml 72% sulfuric acid was heated at 170° for 2 hr. The hot mixture was poured into water and the resulting precipitate collected by filtration. The solids were then steam distilled to give 7-methyl-1,2-benzopyrone, mp 128°. The spectroscopic properties of this product were identical to those reported in Example 1. Reverse-phase high performance liquid chromatography showed the products of Examples 1 and 2 to have identical retention times and a purity of 98% or higher.

EXAMPLE 3

The 7-methyl-1,2-benzopyrones of Examples 1 and 2 both had an odor strongly reminiscent of ground tonka beans. Upon application of 7-methyl-1,2-benzopyrone from either Example 1 or Example 2 to cigarette tobacco at 100 ppm, a panel of experts found the cigarette smoke to have an enhanced tobacco character with a smooth sweetness reminiscent of deertongue extract. This evaluation of the flavor properties of 7-methyl-1,2-benzopyrone and those presented in subsequent examples were made by smoking two cigarettes which were identical in all respects with the exception that one of the two contained a homogeneous distribution of the test compound at the level of application indicated. The organoleptic characteristics of 7-methyl-1,2-benzopyrone were more complex than those of 7-methoxy-1,2-benzopyrone, and much closer to those of deertongue or tonka bean.

In addition to its greater similarity to deertongue and tonka, 7-methyl-1,2-benzopyrone possesses several added advantages over the 7-methoxy-1,2-benzopyrone of U.S. Pat. No. 4,163,453. It is substantially less expensive; it can be made for about one-third to one-half of the cost of the 7-methoxy compound. In addition, it is less toxic. In toxicity studies in rats, the $LD_{50}$ for 7-methyl-1,2-benzopyrone was 3.25 times the $LD_{50}$ for 7-methoxy-1,2-benzopyrone, while in the DBA mouse, the $LD_{50}$ of the 7-methyl compound was 1.72 times that of the 7-methoxy compound. Pathologic examination of the livers of the ABA mice showed less liver damage attributable to the 7-methyl-1,2-benzopyrone than the methoxy compound.

It should be appreciated that in the art of flavor blending a variety of effects are possible from a flavorant depending on the amounts of flavorant used and the nature of the substrate. Therefore, the present invention contemplates the blending of 7-methyl-1,2-benzopyrone with other flavorants and the application of these flavor mixtures to a variety of tobacco substrates, both synthetic and natural tobaccos. The amount to be blended with the other flavorants is of course optional depending on the particular effect one is trying to achieve and the type of tobacco or tobaccos to which the mixture is added.

It will be appreciated that while embodiments of this invention are shown above, the invention is not to be limited thereto, since many modifications can be made by those skilled in the art without departing from the spirit and scope of the invention as set forth in the appended claims.

What is claimed is:

1. A method for improving the flavor and aroma of a tobacco product which comprises adding thereto 7-methyl-1,2-benzopyrone in an amount from about 0.0001 to about 0.1 percent by weight of the tobacco.

2. The method of claim 1 wherein the amount of 7-methyl-1,2-benzopyrone added to the tobacco is from about 0.001 to about 0.01 percent by weight of the tobacco.

3. A tobacco product having added thereto 7-methyl-1,2-benzopyrone in an amount from about 0.0001 to about 0.1 percent by weight of the tobacco.

4. The product of claim 3 wherein the amount of 7-methyl-1,2-benzopyrone added to the tobacco is from about 0.001 to about 0.01 percent by weight of the tobacco.

5. A tobacco product of claim 3 in the form of a cigarette.

* * * * *

UNITED STATES PATENT AND TRADEMARK OFFICE

CERTIFICATE OF CORRECTION

PATENT NO. : 4,319,585

DATED : March 16, 1982

INVENTOR(S) : Andrew G. Kallianos et al.

It is certified that error appears in the above-identified patent and that said Letters Patent is hereby corrected as shown below:

Column 3, line 24, "7.255" should read -- 7.25δ --.

This certificate supersedes Certificate of Correction issued July 6, 1982.

Signed and Sealed this

*Fifth* Day of *October 1982*

[SEAL]

*Attest:*

GERALD J. MOSSINGHOFF

*Attesting Officer*

*Commissioner of Patents and Trademarks*